US007739838B2

(12) United States Patent
Borglum et al.

(10) Patent No.: US 7,739,838 B2
(45) Date of Patent: Jun. 22, 2010

(54) QUICKLY AND EASILY ASSEMBLEABLE PORTABLE BLEACHER

(76) Inventors: Keith B. Borglum, 218 Loma St., Waterloo, IA (US) 50701; Carl H. Arns, 105 River View Cir., Shell Rock, IA (US) 50670

( * ) Notice: Subject to any disclaimer, the term of this patent is extended or adjusted under 35 U.S.C. 154(b) by 1193 days.

(21) Appl. No.: 11/295,196

(22) Filed: Dec. 6, 2005

(65) Prior Publication Data

US 2006/0070199 A1 Apr. 6, 2006

(51) Int. Cl.
*E04H 3/12* (2006.01)
*E04F 11/00* (2006.01)

(52) U.S. Cl. ..... 52/8; 52/182; 52/188

(58) Field of Classification Search ..... 52/6, 52/8, 9, 182, 188, 191
See application file for complete search history.

(56) References Cited

U.S. PATENT DOCUMENTS

| | | | | | |
|---|---|---|---|---|---|
| 1,624,721 | A | * | 4/1927 | Duke | 52/8 |
| 1,715,885 | A | * | 6/1929 | Annand et al. | 52/8 |
| 1,875,115 | A | * | 8/1932 | Oberdorfer | 52/654.1 |
| 2,186,866 | A | * | 1/1940 | Hussey | 52/690 |
| 2,193,339 | A | * | 3/1940 | McCann | 52/690 |
| 2,295,311 | A | * | 9/1942 | Uecker et al. | 52/8 |
| 2,985,924 | A | * | 5/1961 | Burke | 52/8 |
| 3,117,350 | A | * | 1/1964 | Margadant | 52/8 |
| RE30,830 | E | * | 12/1981 | Wenger et al. | 182/113 |
| 4,345,406 | A | * | 8/1982 | Motley | 52/8 |
| 4,412,403 | A | * | 11/1983 | LeFranc et al. | 52/9 |
| 4,571,895 | A | * | 2/1986 | Lyman, Jr. | 52/9 |
| 4,611,439 | A | * | 9/1986 | Graham, Jr. | 52/9 |
| 4,631,874 | A | * | 12/1986 | Griffin, Jr. | 52/8 |
| 5,159,788 | A | * | 11/1992 | Merrick | 52/8 |
| 5,605,025 | A | * | 2/1997 | Paddock | 52/741.3 |
| 5,661,928 | A | * | 9/1997 | Beu | 52/9 |
| D404,141 | S | * | 1/1999 | Borglum | D25/38 |
| 6,474,024 | B1 | * | 11/2002 | Macintyre | 52/9 |
| 6,539,672 | B1 | * | 4/2003 | Frost | 52/9 |
| 2002/0056239 | A1 | * | 5/2002 | Paddock | 52/183 |
| 2002/0078633 | A1 | * | 6/2002 | Jines et al. | 52/8 |
| 2005/0062258 | A1 | * | 3/2005 | Borglum | 280/490.1 |

* cited by examiner

*Primary Examiner*—Richard E Chilcot, Jr.
*Assistant Examiner*—Ryan D Kwiecinski
(74) *Attorney, Agent, or Firm*—Andrus, Sceales, Starke & Sawall, LLP

(57) ABSTRACT

An easily and quickly assembleable bleacher includes basic light-weight component which can be assembled by one person, if necessary, and without the use of tools. The assembly includes a latching and locking mechanism for attaching the seat boards, foot boards and riser boards without the use of fasteners, and most of the other connections are made with pinned connections that save time and assembly. The upper guard rails are attached to lie in a slight rearwardly angled plane that provides comfort for the spectators and also facilitates assembly.

33 Claims, 9 Drawing Sheets

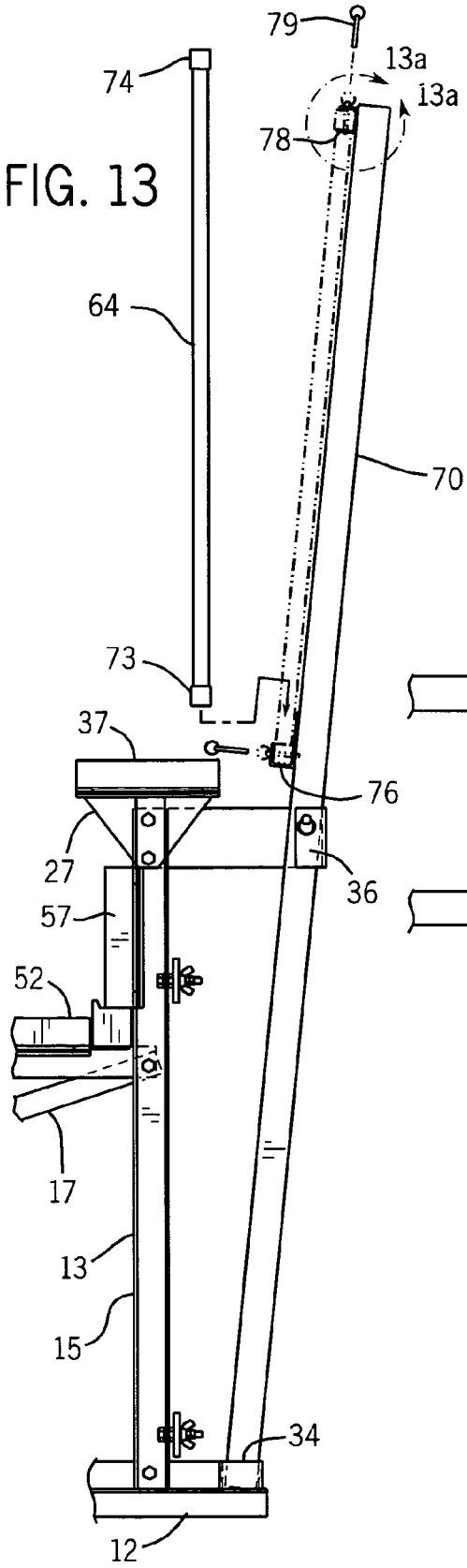
FIG. 13
FIG. 13a
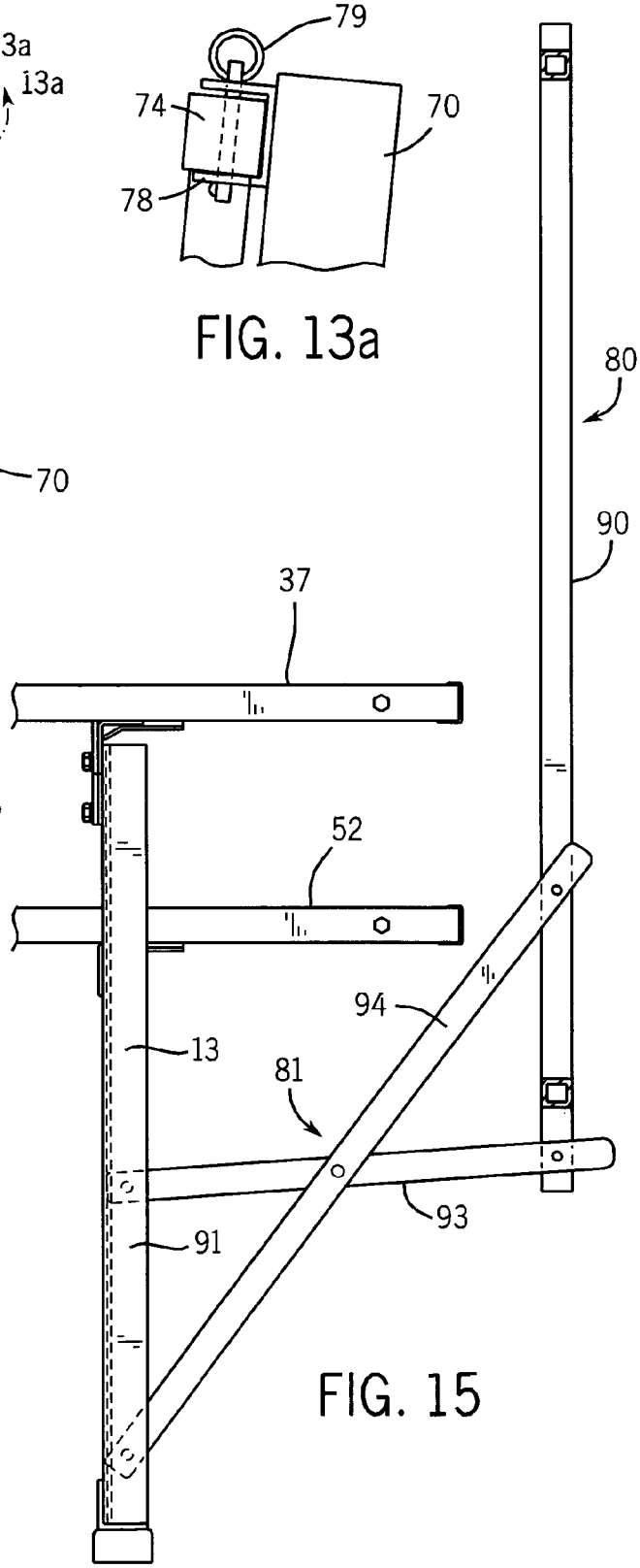
FIG. 15

QUICKLY AND EASILY ASSEMBLEABLE PORTABLE BLEACHER

BACKGROUND OF THE INVENTION

The present invention pertains to a bleacher for seating spectators and, more particularly, to a portable bleacher the components of which are easily and quickly assembleable without the use of tools.

Bleachers for spectator seating are old and well known. Some bleachers are installed permanently while others may be folded or collapsed for relocation and/or storage. It is also known to provide a portable bleacher that can be assembled from basic components and, similarly, disassembled for relocation and/or storage.

Although standard bleachers that are assembled from basic components greatly facilitate storage and transport, they suffer from the disadvantage of long, time-consuming and tedious assembly, utilizing many bolted or similar threaded connectors that inherently require substantial time in the assembly. There is, therefore, a need in the industry for a portable bleacher that is easily and quickly assembleable from basic components, yet meets all the requirements for strength and comfort.

SUMMARY OF THE INVENTION

In accordance with the present invention, an easily and quickly assembleable bleacher is provided in an assembly of basic light-weight components which can be assembled, if necessary, by one person and without the use of tools. Each of the seat boards and foot boards, and optional riser boards, is demountably attached to board supports with a board latching mechanism actuated by horizontal movement of the board, preferably along its longitudinal axis, on the supports. A bleacher having multiple rows and various seat lengths can be provided in accordance with the present invention.

In a basic embodiment, the bleacher comprises two or more main frame members each of which has a stepped construction that is defined by a plurality of horizontally spaced frame posts. The frame posts increase in length serially from front to rear and have, at their upper ends, a support for a seat board. The lower ends of the frame posts are attached to a supporting lower frame member. Structural foot board supports interconnect each pair of adjacent frame posts on a main frame member. A seat board is demountably attachable to the supports of equal height frame posts with a seat board latching mechanism that is actuated by horizontal movement of the seat board on the supports. A foot board is demountably attached to the foot board supports between common pairs of adjacent frame posts with a foot board latching mechanism that is actuated by horizontal movement of the foot board on the foot board supports. It is also desirable to include a riser board that is demountably attachable to selected equal length frame post groups with a riser board latching mechanism that, in a manner similar to the seat board and foot board mechanisms, is actuated by horizontal movement of the riser board the frame posts.

The present invention also includes a method for easily and rapidly assembling a bleacher, the method comprising the steps of (1) providing at least two main frame members, each having a stepped construction defined by a plurality of horizontally spaced frame posts, the frame posts increasing serially in height from front to rear and having at their upper ends a support for a seat board, the lower ends of the frame posts attached to a lower frame member, and a substantially horizontal foot board support interconnecting each pair of adjacent frame posts; (2) interconnecting the main frame members with a brace assembly; (3) attaching a seat board to the supports of the equal height frame posts with a seat board latching mechanism that is actuated by horizontal movement of the seat board on the supports; and (4) attaching a foot board to the foot board supports between common pairs of adjacent frame posts with a foot board latching mechanism that is actuated by horizontal movement of the foot board on the foot board supports.

In one presently preferred embodiment, the bleacher comprises at least two main frame members each of which has a stepped construction that is defined by a plurality of horizontally spaced frame posts. The frame posts increase serially in length from front to rear and have at their upper ends a support for a seat board. The lower ends of the frame posts are attached to a lower frame member. A horizontal foot board support interconnects each pair of adjacent frame posts. A cross brace assembly is utilized to connect all or selected pairs of equal length frame posts to provide rigidity to the structure. A seat board is demountably attachable to the supports of equal length frame posts utilizing a seat board latching mechanism that is actuated by horizontal movement of the seat board on the supports. A foot board assembly is demountably attachable to the foot board supports between common pairs of adjacent frame posts utilizing a foot board latching mechanism, similar to the seat board latching mechanism, that is actuated by horizontal movement of the foot board assembly on the foot board supports.

A rear guard rail assembly is demountably attachable to the rearmost frame posts and includes a guard rail section that extends between the rearmost frame posts. A side guard rail is demountably attachable at a rear end to each end of the rear guard rail assembly and at a front end to the associated main frame member.

The bleacher also preferably includes a riser board that is demountably attachable to selected equal length frame post groups with a riser board latching mechanism, similar to the seat board and foot board latching mechanisms, that is actuated by horizontal movement of the riser board on the frame posts.

In a presently preferred embodiment, the seat board support comprises a flat tongue that has an upper seat board-supporting face, and the seat board latching mechanism includes a latch plate that defines, with the underside of the seat board, a slot adapted to receive the flat tongue in response to horizontal movement of the seat board. The latching mechanism includes a latch bar that is pivotally attached at one end to and recessed in the seat board on a horizontal pivot axis transverse to the direction of seat board movement. The latch bar has an abutment notch on the other end that is adapted to drop into engagement with the seat board support in response to receipt of the tongue in the slot and downward pivotal movement of the notched end of the latch bar.

Preferably, the foot board assembly comprises a pair of foot boards placed in edge-to-edge engagement. The foot board support comprises a flat support plate that has an upper foot board-supporting face and a free edge. The foot board latching mechanism includes a latch plate for each foot board that defines with the underside of the foot board a slot adapted to receive the free edge of the support plate in response to horizontal movement of the foot board. A latch bar is provided for each foot board that is pivotally attached at one end to and recessed in the foot board on a horizontal pivot axis transverse to the direction of foot board movement. The latch bar has an abutment notch on the other end that is adapted to drop into engagement with the foot board support in response to receipt of the free edge of the support plate in the slot and downward pivotal movement of the notched end of the latch bar. In the preferred embodiment, downward movement of the latch bar for both the seat board latching mechanism and the foot board latching mechanism occurs by gravity.

In a preferred construction, the frame posts in the selected groups include a flat flange that provides a riser board-engaging face and a free edge. The riser board latching mechanism, in a manner similar to the previously described latching mechanisms, includes a latch plate that defines with the side of the riser board a slot adapted to receive the free edge of the flange in response to horizontal movement of the riser board. A latch bar is pivotally attached at one end to and recessed in the engagement face of the riser board on a vertical pivot axis transverse to the direction of riser board movement. The latch bar has an abutment notch on the other end that is adapted to be moved into engagement with the frame post after receipt of the edge of the flange in the slot and horizontal pivotal movement of the notched end of the latch bar. Because the latch bar does not move into engagement with the frame post by gravity, a locking mechanism is preferably provided that is operative to retain the abutment notch in engagement with the frame post.

It is preferred to interconnect all pairs of equal length frame posts with a cross brace assembly. Each cross brace assembly preferably comprises a pair of elongate brace members pinned together at their centers and connected at opposite ends in the form of an X to respective upper and lower ends of the frame posts.

In a preferred embodiment of the bleacher, the rear guard rail assembly comprises a pair of substantially vertical rear posts, each of which is supported at a lower end on the rear end of the lower main frame member and operatively connected at an intermediate location to the upper end of a rearmost frame post. The rear post has a free upper end that extends above the intermediate connection point. The guard rail section comprises frame members that connect a plurality of parallel rails. Each rear guard rail section has a horizontal lower frame member that is supported at opposite ends on the rear posts adjacent the intermediate locations and a horizontal upper frame member that is supported at opposite ends on the rear posts adjacent the upper ends thereof. The lower end of the rear post is supported in an upwardly opening cup attached to the rear end of the lower main frame member. The operative connection of the rear post to the upper end of the rearmost frame post may comprise a generally horizontal J-bracket that is connected by the free end of its longer leg to the frame post and positioned to define with its shorter leg a forwardly opening channel for receipt of the post. Preferably, the rear posts extend rearwardly at a small angle to the vertical from the lower to the upper ends thereof such that the guard rail section lies in a plane extending rearwardly at said angle.

In accordance with the preferred embodiment of the invention, the guard rail lower frame member is supported in upwardly opening channel brackets that are attached to the rear posts. The guard rail upper frame member is supported in forwardly opening channel brackets attached to the rear posts.

Each side guard rail comprises a plurality of parallel rails that are connected by an upper side frame member and a lower side frame member. The side guard rail also includes a rearmost rail that is angled to lie parallel with the plane of the rear guard rail section and is connected at its upper and lower ends to the endmost rail of the rear guard rail section. One of the parallel rails near the front of the side guard rail is attached to an adjacent frame post with a connecting brace. Preferably, the angled rail is connected to the endmost rail of the rear guard rail section with connectors that permit rotation of the side guard rail to facilitate connection to the connecting brace.

The connections of the rear posts to the J-brackets, the connections of guard rail lower and upper frame members to the respective upwardly and forwardly opening channel members, and the connection of the side guard rail to the rear guard rail section are secured with easily removable pins.

BRIEF DESCRIPTION OF THE DRAWINGS

FIG. 13 is a side elevation view of the rear post assembly and its attachment to the main frame members.

FIG. 13*a* is a detail taken on line 13*a*-13*a* of FIG. 13, showing the connection of the rear guard rail assembly to the rear post.

FIG. 15 is a front elevational detail of the connection of the forward end of the side guard rail section to the main frame member.

DETAILED DESCRIPTION OF THE PREFERRED EMBODIMENT

The portable and easily and quickly assembleable bleacher of the present invention will be described to simultaneously define the construction of the components and subassemblies and the method by which they are assembled. The order of certain of the assembly steps may be varied considerably as will be mentioned below. Nearly the entire bleacher is made of aluminum or other light weight components that contribute greatly to the ease and rapidity with which the bleacher can be assembled.

Figure 1:
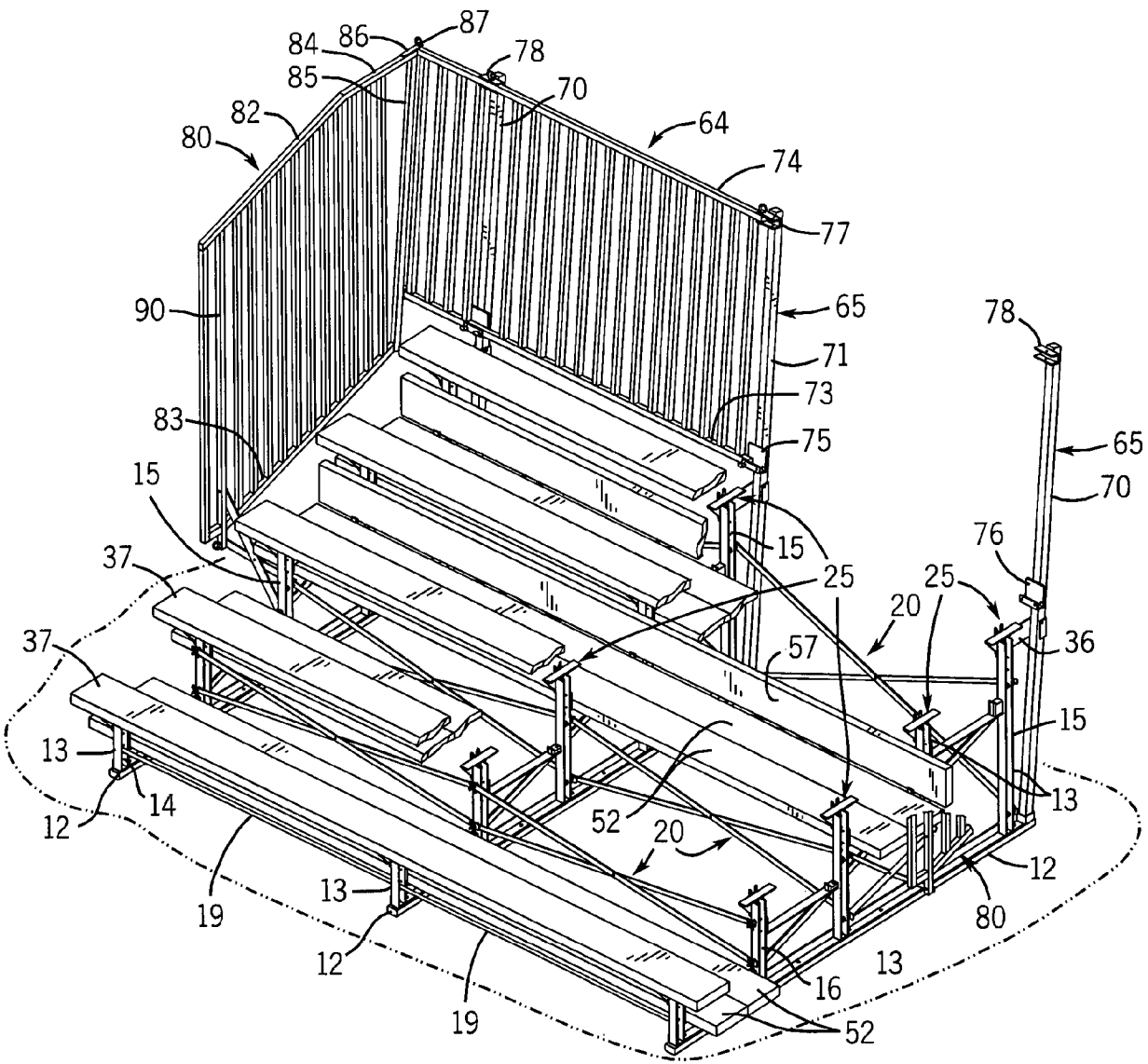
FIG. 1 is a perspective view of a partially assembled bleacher of the present invention with portions of some components broken away for clarity.
Figure 2:
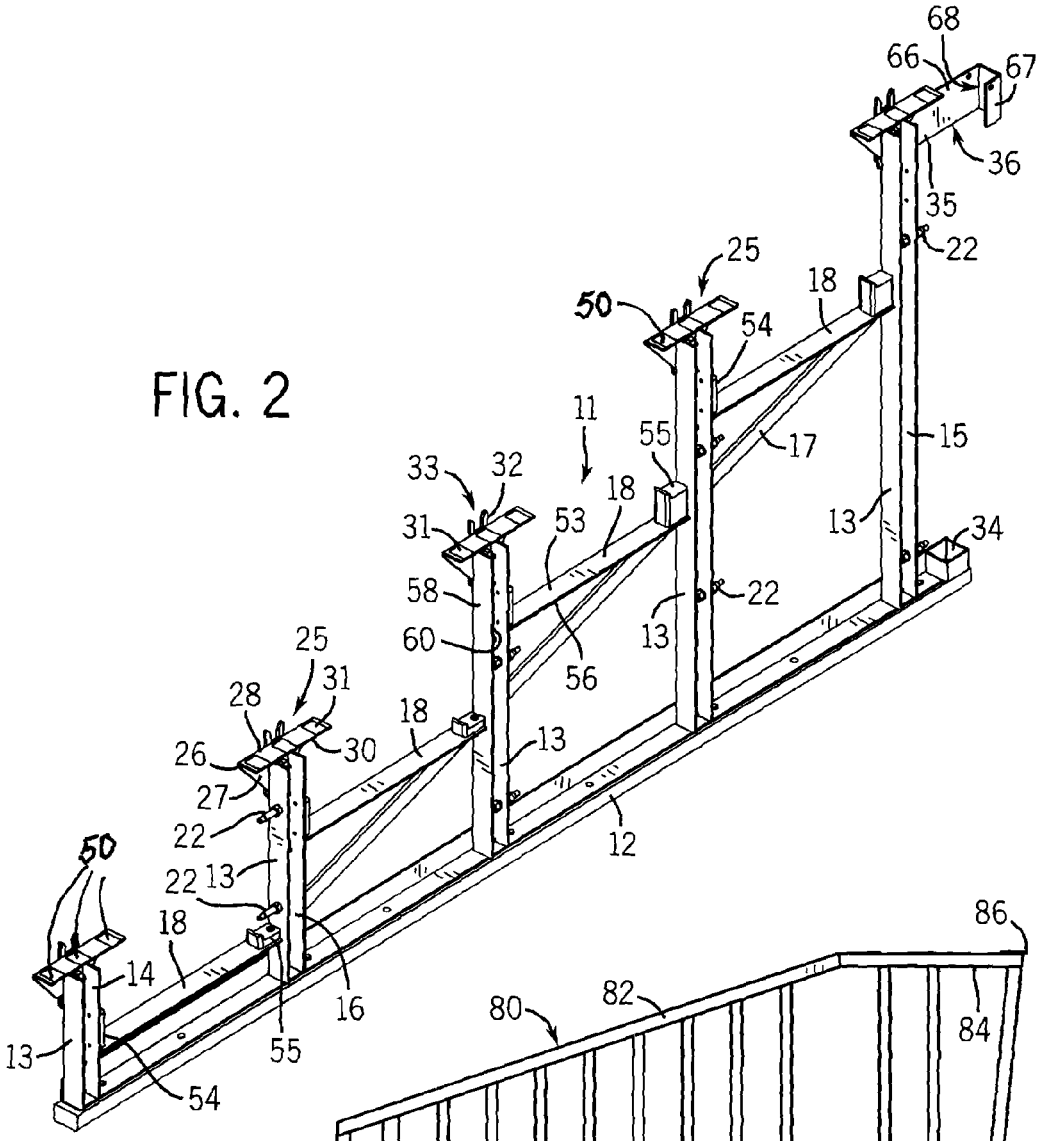
FIG. 2 is a perspective view of a main frame member for the bleacher assembly.
Figure 4:
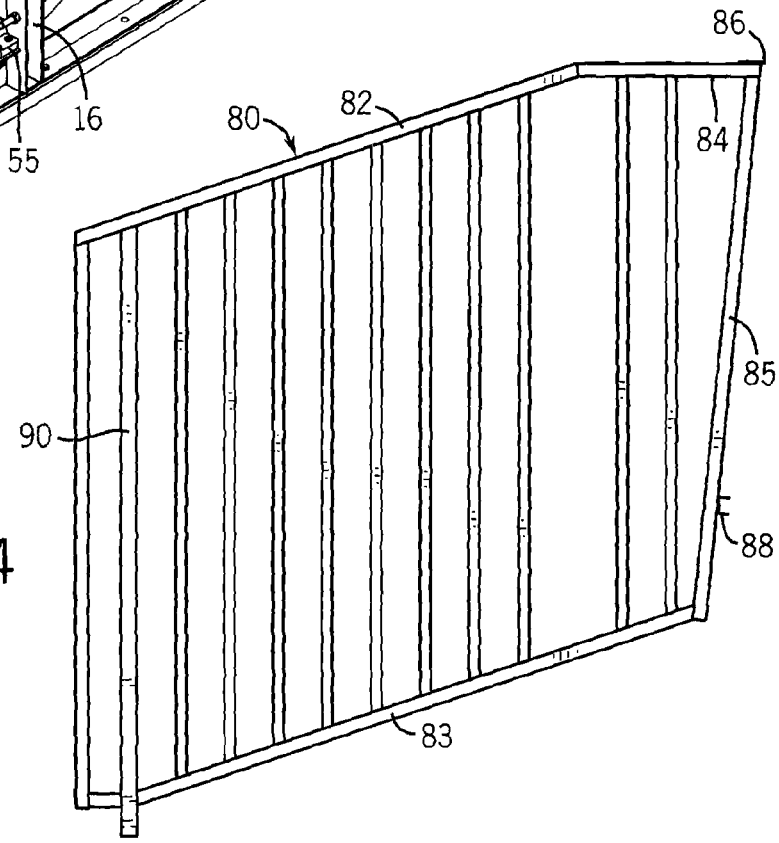
FIG. 4 is an elevation view of a side guard rail section.
Figure 3:
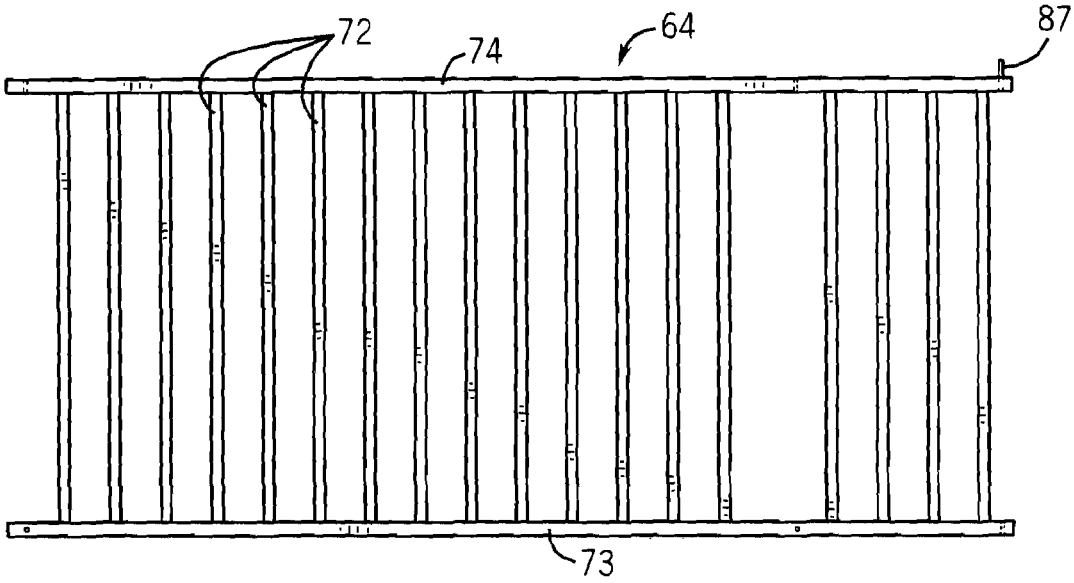
FIG. 3 is an elevation view of a rear guard rail section.
Figure 5:
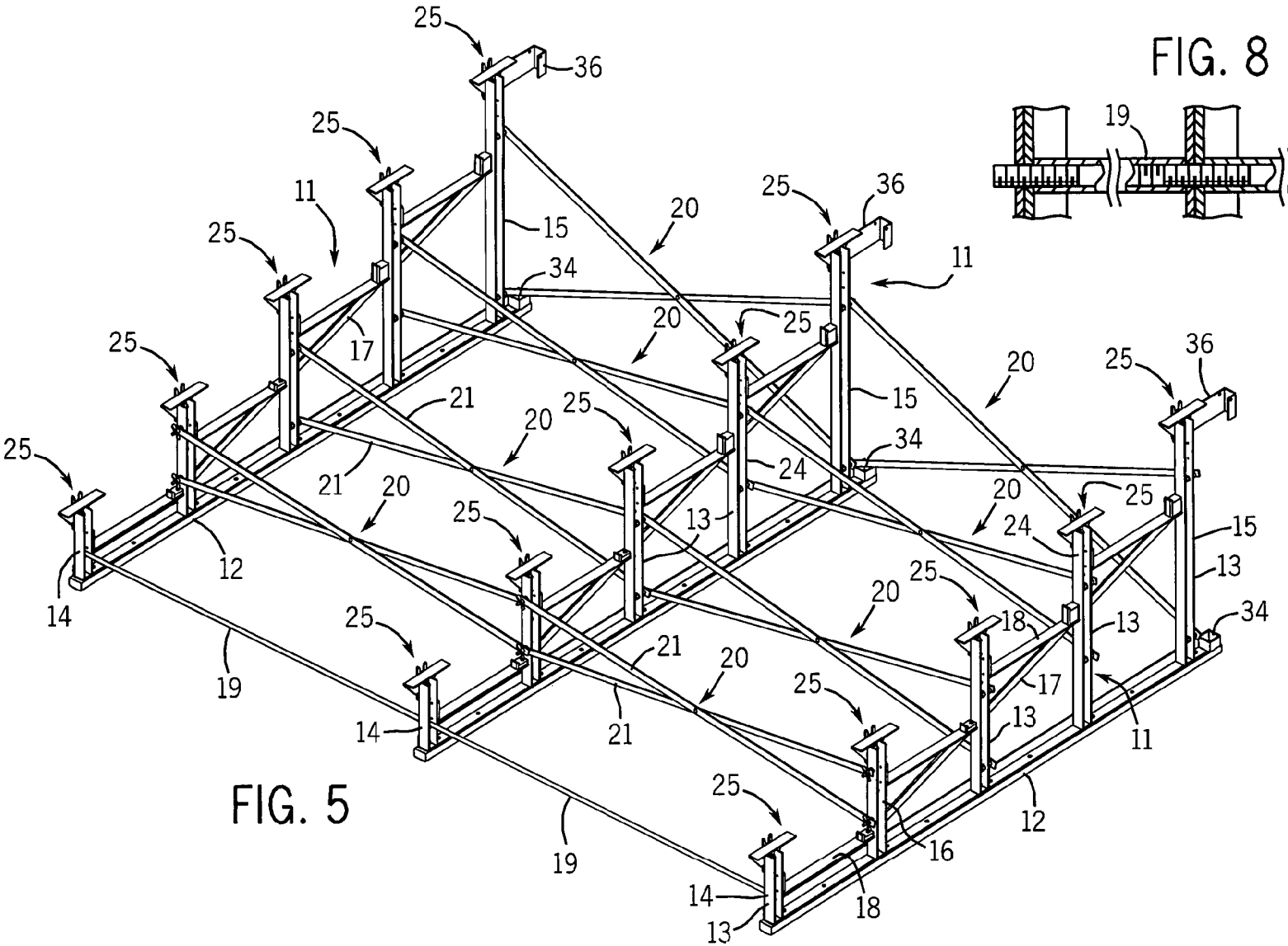
FIG. 5 is a perspective view showing the structural interconnection of the main frame members for the bleacher shown in FIG. 1.

Referring initially to FIGS. 1, 2 and 5, the bleacher 10 of the present invention is assembled on and supported by two or more main frame members 11. Each main frame member includes a lower frame member 12 which, in the embodiment shown, is a structural angle. A plurality of vertical frame posts 13 are attached at their lower ends to the lower frame member 12, the frame posts increasing serially in length from front to rear along the lower frame member in a step-like manner. Each of the frame posts 13 is preferably made from a pair of structural angles that are bolted together with a common overlapping flange to form a fabricated channel member. A more conventional channel member could also be used. As may be seen in the drawings, there are five frame posts in this embodiment which vary in length from the shortest frontmost post 14 to the longest rearmost post 15. To provide rigidity to the main frame 11, an angled brace 17 extends from the lower end of the second frame post 16 to the upper portion of the rearmost frame post 15. In addition, each adjacent pair of frame posts 13 is interconnected by a horizontal angle member 18, each of which also functions as a foot board support, as will be described in greater detail below.

A bleacher of the present invention may utilize as few as two main frame members 11, but a larger number may be used, limited only by practical considerations such as length and portability. In the embodiment shown, there are three main frame members 11 that are spaced laterally apart by 6 feet. In the assembly process, the main frame members 11 are placed in their approximate laterally spaced positions and are interconnected by a series of cross brace assemblies 20. Each cross brace assembly comprises a pair of brace members 21 that are pinned together at their centers, but are free to move rotationally with respect to one another on the axis of the pinned connection. The free end of each brace member 21 extends between the lower end of a frame post 13 and the upper end of a laterally adjacent frame post 13 of the same length to form an X-shaped brace assembly 20. The connections of the brace members 21 to the frame posts 13 is effected through the use of threaded studs attached to either a front flange or a rear flange of the post. Clearance holes in the ends of the brace members 21 permit them to be positioned on the threaded studs 22 and are secured in place with nuts such as wing nuts 23. It is understood, however, that the cross brace assemblies may be attached to the main frame members 11 with connectors other than the threaded studs 22 and wing nuts 23 to speed up the assembly of the bleacher. However, the threaded connectors provide somewhat better rigidity to the structure than would looser pinned connections.

Although each laterally adjacent pair of equal length frame posts 13 is connected with a cross brace assembly 20, it is preferred to interconnect the front row of frame posts 13 with threaded and tapped rods 19, instead of cross brace assemblies 20. Each rod 19 is preferably made from a hollow steel tube, one end of which has welded thereon a threaded stud and the opposite end has welded therein a nut. The threaded stud on one rod 19, extends through a hole in the frame post 13 on the far end of the bleacher where it is attached with a nut. The threaded stud on the end of the next rod 19 passes through a hole in the next frame post 13 and is threaded into the nut in the end of the first rod 19. The other end of the second rod is secured in position with a bolt that extends through a hole in the third frame post 13. This arrangement best shown in FIG. 5. For example, the cross brace assemblies 20 interconnecting the second posts 16 could be eliminated, as could the cross brace assemblies 20 interconnecting the fourth posts 24.

A seat board support 25 is attached to the upper end of each frame post 13. Each seat board support 25 also functions to act with a latching mechanism to hold the seat board in place, as will be described in greater detail. Each seat board support 25 is made from an angle member 26, the vertical flange 27 of which is attached to the frame post 13 such that the horizontal flange 28 defines a flat tongue 30 having a flat upper face 31 for supporting a seat board. A seat board guide member 32 is also attached to the vertical flange 27 of the angle member 26 and has an upper centering slot 33 that extends above the plane of the board supporting face 31.

Each main frame member 11 is also provided with an upwardly opening square or rectangular cup 34 that is attached to the rear end of the lower frame member 12, just rearwardly of the rearmost frame post 15. At the upper end of the rearmost frame post 15, the free end 35 of the longer leg of a J-bracket 36 is attached.

As so far described, the main frame member 11 with all of the described attachments is preferably preassembled to facilitate rapid assembly of the bleacher.

With the preassembled main frame members 11 interconnected by some or all of the cross brace assemblies 20, as shown in FIG. 5, the assembly is now ready for attachment of the seats and walkways to facilitate access and use, and the riser boards and guard rails to enhance both utility and safety. Although one sequence of attaching these pieces will be described, it is understood that the above mentioned seats, walkways, rise boards and guard rails can be assembled in many varied or orders or sequences.

Figure 11:
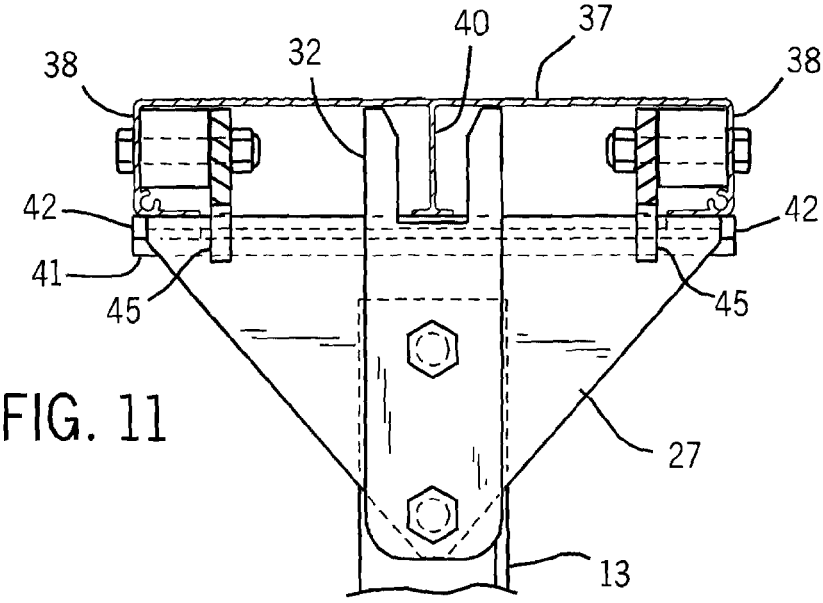
FIG. 11 is a sectional detail taken on line 11-11 of FIG. 10.
Figure 10:
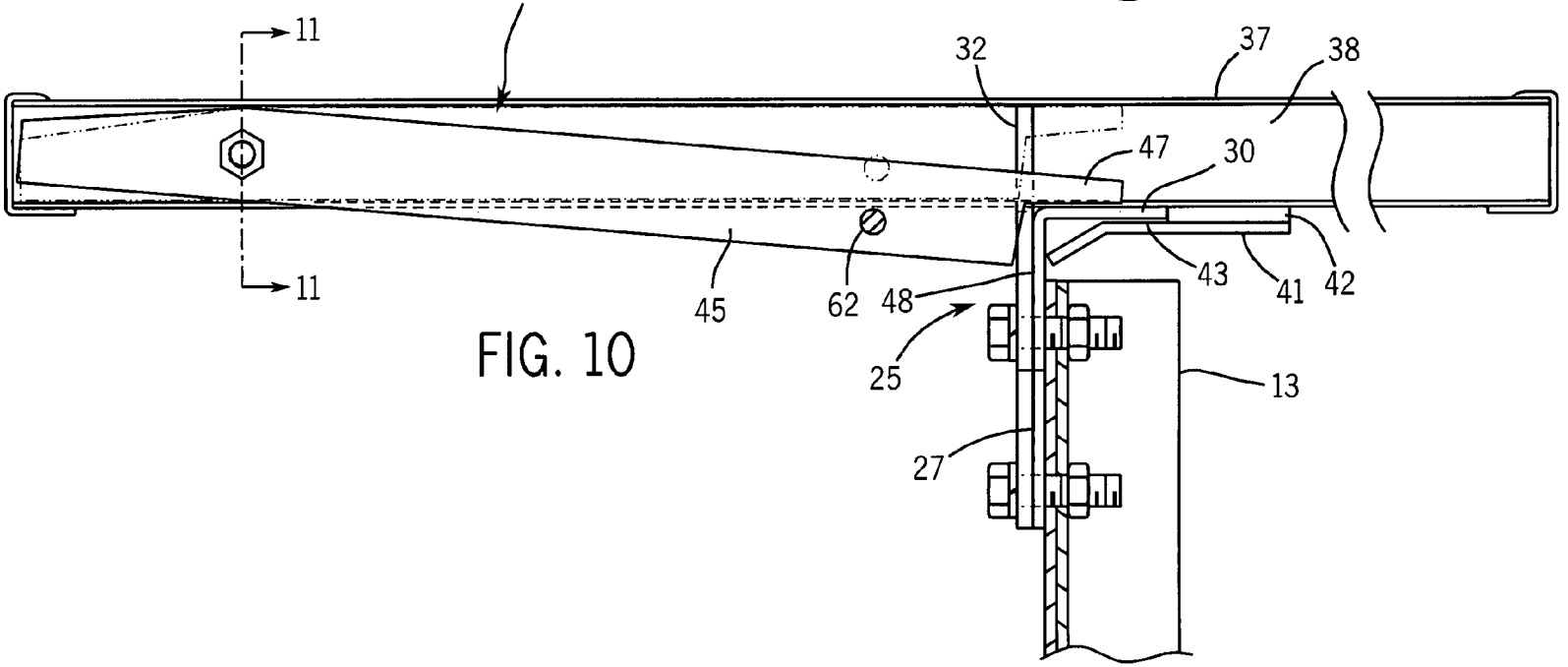
FIG. 10 is an elevational detail of the seat board latching and locking mechanism.

Referring to FIG. 11, a seat board 37 is made from an aluminum extrusion and is adapted to be supported on and attached to the seat board supports 25 of each laterally extending row of frame posts 13. The seat board 37 may be extruded in any cross sectional shape, but in the embodiment shown, the seat board 37 has a flat upper surface (which may be provided with shallow closely spaced grooves to improve traction), a pair of integral L-shaped side rails 38 on opposite sides of the board, and a lipped center flange 40 which runs then length of the seat board parallel to the side rails 38. A latch plate 41 is attached to the underside of the seat board 37 to substantially span the width thereof and is secured to the bottom faces of the side rails 38 with intermediate spacers 42 (FIGS. 10 and 12) to define a slot 43. The edge of latch plate 41 may be angled downwardly to provide a lead-in. The slot 43 is just slightly wider than the tongue 30 of the seat board support flange 28.

When it is desired to attach a seat board to the seat board supports 25, the seat board 37 is laid on the flat upper faces 31 of the latch tongues 30 with the open slots 43 spaced laterally from the tongues 30 of the seat board supports 25. To center the seat board on the tongues, the board center flange 40 is received in the centering slots 33 of the guide members 32 which, as described above, extend upwardly above the flat supporting surface of the tongues 30. The seat board 37 is then slid over the flat supporting surfaces 31 until the tongues 30 are received in their respective slots 43 and the free lead edges of the tongues engage the side edges of the spacers 42. The seat board is thus latched to the frame posts 31 and cannot be lifted vertically, moved laterally, or moved further in the latching direction.

Figure 9:
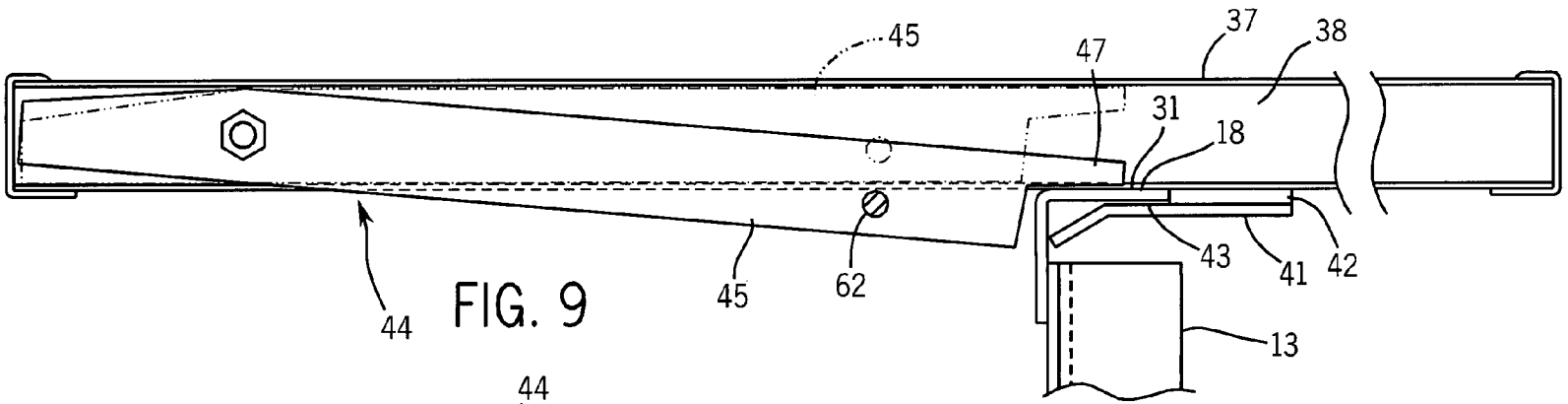
FIG. 9 is an elevational detail of the foot board latching mechanism.

However, because the seat board 37 could still be moved longitudinally in the reverse direction, resulting in the unlatching of the seat latching mechanism, a latch bar mechanism 44 is utilized to prevent such movement. In the embodiment shown and referring to FIGS. 9-11, a pair of latch bars 45 are pivotally attached at one end to the respective side rails 38 of the seat board 37 in such a manner that the bars may be completely recessed in the underside of the seat board. Each latch bar 45 extends from its pivot in the direction opposite the direction of sliding movement of the seat board to effect latching. In addition, each latch bar 45 is provided with an abutment notch 46 in its free end. In the phantom lines shown in FIG. 9, the latch bars are recessed in the underside of the seat board 37 just before final longitudinal movement of the seat board to cause the tongues 30 to be received in the slots 43. In this position, the latch bars 45 are held in their recessed positions by contact with the flat upper surfaces 31 of the tongues 30. As the seat board is slid in the latching direction and the tongues 30 are received fully in the slots 43, the force of gravity causes the notched ends of the latch bars 45 to drop downwardly until notch fingers 47, defining the horizontal face of the notch, contact the upper face 31 of the tongue 30. Correspondingly, the generally vertical abutment faces 48, defining the other face of the notch 46, contact the outside of the vertical flange 27 and prevent reverse unlatching movement of the seat board. Only one latching mechanism is necessary for a seat board and is preferably located at the end defined by the direction of latching movement of the seat board. As shown in the drawings, the seat boards 37 preferably extend about 18 inches beyond the endmost frame posts 13. In disassembly, the free ends of the latch bars 45 are conveniently lifted by the fingers, the seat board slid in the unlatching direction until the tongue 30 has cleared the slot 43, whereupon the seat board may be lifted vertically and carried away.

Figure 12:
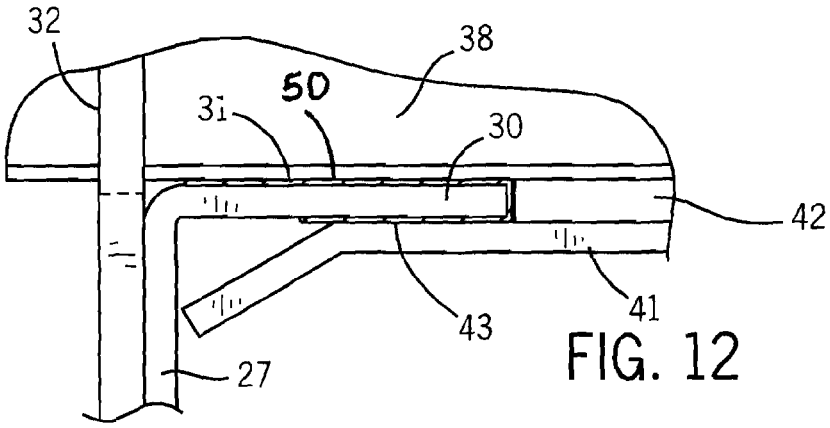
FIG. 12 is an elevational detail of the latching mechanism showing the friction-reducing bearing material.
Figure 8:
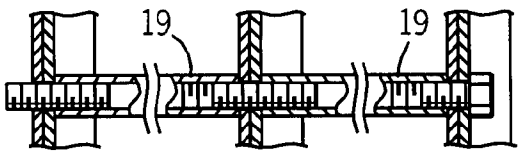
FIG. 8 is a detail of the main frame connecting rods shown in FIG. 5.

Referring to FIG. 12, to facilitate sliding movement of the seat board 37 over the flat upper faces 31 of the tongues 30, low friction bearing strips 50 may be adhered to flat upper faces 31 where they are slidably engaged by the bottoms of the side rails 38 and lipped center flange 40 of the seat board. Any of many suitable relatively tough low friction materials, such as HDPE, may be used.

Between each pair of seat board 37 a foot board assembly 51 is attached and, desirably, spans almost all of the space front-to-back between the frame posts 13 that carry the seat boards. Each foot board assembly 51 comprises one or more foot boards 52, each of which is similar in construction to the seat board 37 previously described. The pair of foot boards 52 rest on the horizontal upper legs 53 of the angle members interconnecting each pair of frame posts 13. To help center and retain the foot boards 52 in position, a front plastic bearing block 54 is attached to the forward of the frame posts 13 and a rear plastic bearing block 55 is attached to the rear end of the angle member 18 and also rests against the face of the rear frame post 13. The bearing blocks 54 and 55 may be made of HDPE or any other suitable plastic material that is tough and helps reduce friction. Other non-plastic materials could also be used.

Each of the foot boards 52 is provided with a latch plate 41 attached to the board with spacers 42 to define a slot 43 in the same manner as described above with respect to the seat board 37. The horizontal upper leg 53 of the supporting angle member 18 has a free edge 56 that is received in the slot 43 as the foot board is slid from its initial resting position on the horizontal upper leg 53 of the angle member 18 into its latched position. In the same manner as with the seat board 37, the foot boards may include a latch bar mechanism 44 utilizing a pair of laterally spaced latch bars 45. However, one of each latch bar pair may be eliminated on the foot boards 52 and only a single pivotal latch bar 45 used on each foot board 52. Otherwise, the latching, locking, unlocking and unlatching of the foot boards 52 is accomplished in a manner identical to seat board installation and removal.

It may also be desirable for aesthetic purposes and/or to meet safety guidelines to attach a vertically oriented riser board 57 to the frame posts 13 adjacent the rear edge of the foot board assembly 51 and below the front edge of the seat board 37, as best shown in FIGS. 1 and 13. The riser board 57 is similar to the foot board 52 and includes a latch plate 41 separated by spacers 42 from the underside of the board to define a latching slot 43. Also, the latch bar mechanism 44 including one latch bar 45, is preferably included. Referring also to FIG. 2, most conveniently, the flat front flange 58 of the laterally aligned equal length frame posts 13 to which the riser board 57 is attached each has a free edge 60 which is received in the slot 43 to effect latching in the same manner as the tongue 30 for latching the seat board 37 and the horizontal leg 53 of the angle member 18 for latching the foot boards 52.

However, because the riser board 57 is mounted vertically, the latch bars 45 will not drop by gravity to engage the flat side flange 61 of the frame post 13 to lock the seat board in the latched position, the latch bars must be manually pivoted or mechanically biased to the locking position and then themselves locked in position. This accomplished by providing the free ends of the latch bars 45 near the abutment notch 46 with holes 62 into which pins or other fixing devices can be inserted after the latch bars are pivoted to the locking position. It is also possible to design a latch bar which would pivot under the influence of gravity into a locking position whether the board is disposed horizontally (as in a seat board or foot board) or disposed vertically (as with a riser board). By positioning the latch bar pivot axis parallel to the surface of the board, but at an angle to the longitudinal axis of the board (e.g. 45°), a latch bar could be provided that would inherently pivot away from the bottom or back side of the board and into a latching position. It is also possible to orient the seat board supports 25 and the latching and locking mechanism on the underside of the board in a manner requiring horizontal latching movement of the board at an acute angle or even laterally with respect to longitudinal axis of the board. However, such latching movement would not be as convenient for the foot boards 52 and riser boards 57 which are somewhat restricted in such angular or lateral movement because of space limitations.

To maintain the vertical position of the riser board 57 and to facilitate sliding movement thereof, the previously described rear plastic bearing blocks 58 are positioned and sized to automatically position the riser board 57 vertically.

Figure 6:
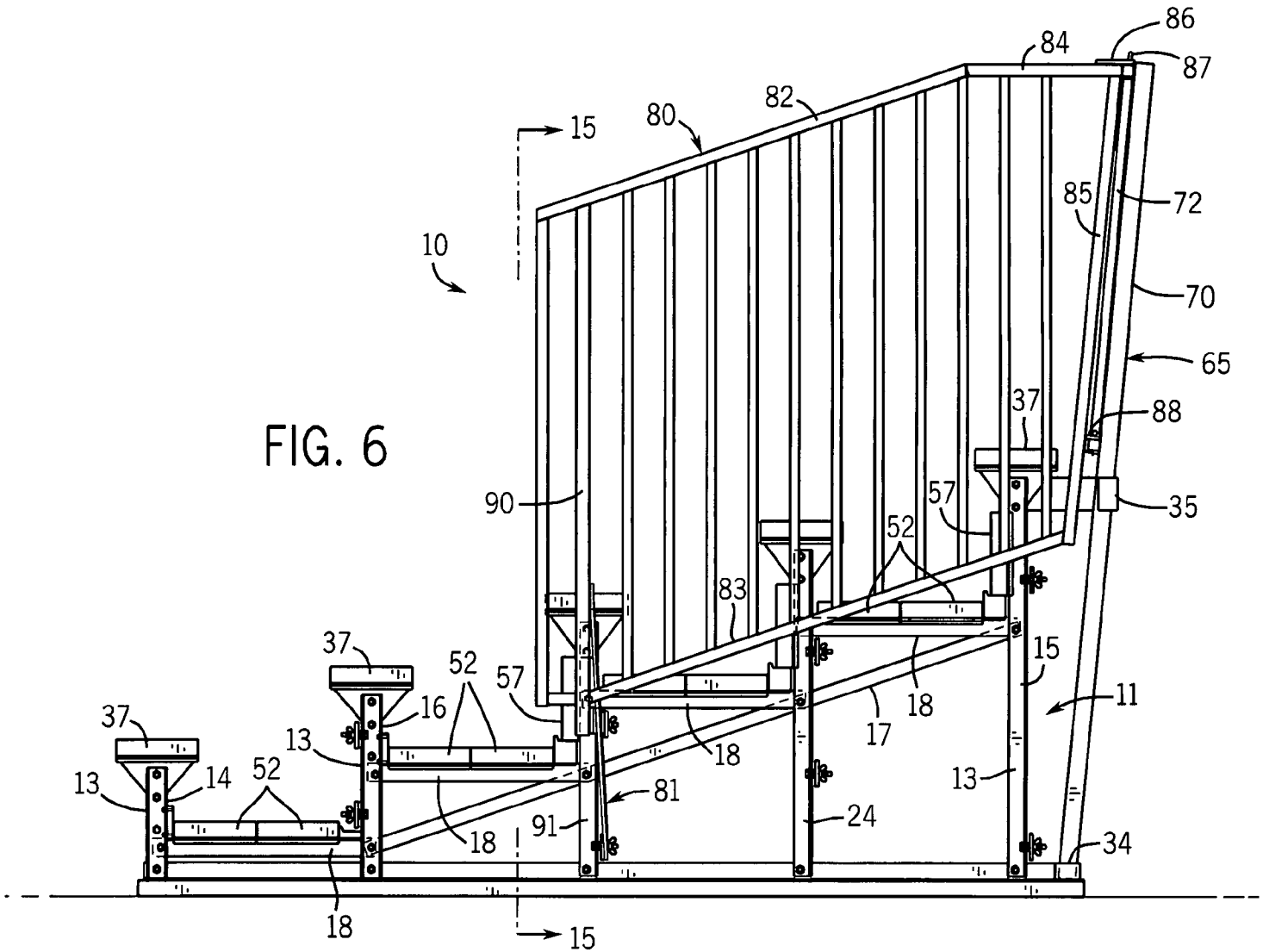
FIG. 6 is a side elevation view of the bleacher shown in FIG. 1.
Figure 7:
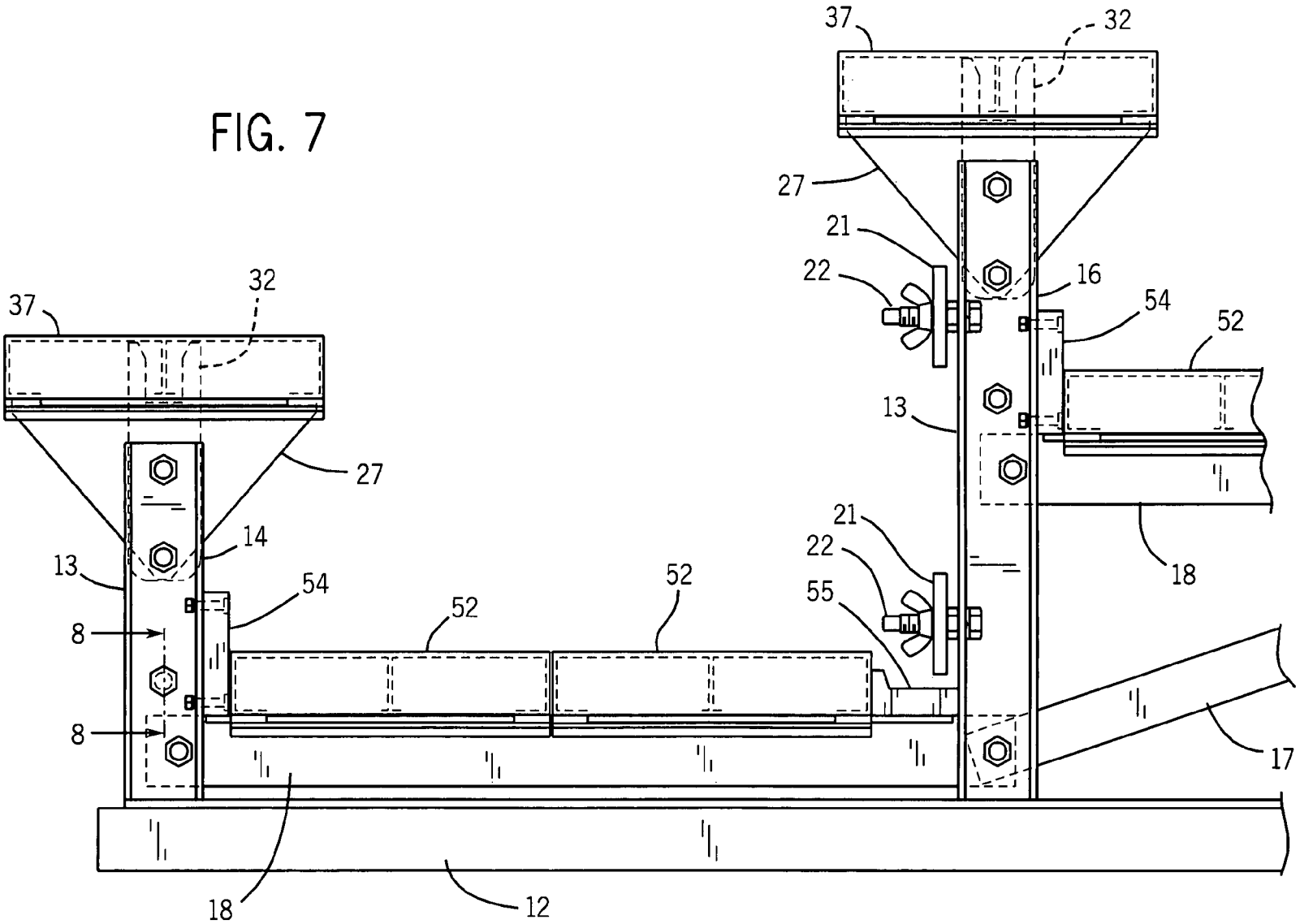
FIG. 7 is an enlarged detail of a portion of FIG. 6.

The bleacher 10 is also provided with a rear guard rail assembly 63 that is operatively attached to the rearmost frame posts 15 and includes a guard rail section 64 or sections that span the length of the bleacher and extended slightly beyond the endmost rear posts 15. As shown in FIGS. 1 and 6, a rear post 65 is attached to each main frame member 11 immediately adjacent and rearward of each rearmost frame post 15. Each of the rear posts 65, which may be either an outer rear post 70 or an interior rear post 17, is preferably made from a square section steel tube and is one of the few structural members of the bleacher assembly that is not made of aluminum. The lower end of the rear post is received in the upwardly opening cup 34 attached to the rear end of the lower frame member 12. The tubular post 65 could be set on a short upwardly projecting post on the lower frame member 15 to provide an alternate type of slip-on connection. Although the posts 65 could be mounted to extend vertically, the posts 65 preferably extend upwardly and rearwardly at a slight angle to the vertical (e.g. about 5°). Each post is held in position at an intermediate point by the J-bracket 36, the longer leg 66 and shorter leg 67 of which are joined to define a forwardly opening channel 68 for receipt of the post 65. The legs 66 and 67 of the J-bracket are provided with aligned holes which also align with a pair of holes on opposite sides of the rear post 65 through which a pin or other suitable connector is inserted to retain the post against movement in any direction. In an alternate construction, the rear posts 65 could be made shorter and attached at their lower ends to cups or other supporting structure on the main frame members 11. Also, the J-bracket could be a different shape and open to either side or to the rear with the post 65 pinned in place in a similar manner. However, a forward opening bracket is preferred because, if the securing pin were for any reason not in place, the rearward leaning post would likely remain in place and be relatively secure.

Each pair of rear posts 65, including an outer rear post 70 and an interior rear post 71, supports and secures a guard rail section 64. Each guard rail section includes a plurality of parallel vertically extending rails 72 (or other type of fence-like barrier) connected by a horizontal lower frame member 73 and a horizontal upper frame member 74. A center J-bracket 75 is attached to the interior rear post 71 just above the horizontally disposed post-supporting J-bracket 36. The center J-bracket 75 defines an upwardly opening channel in which one end of the lower frame member 73 of the guard rail section is supported. The opposite end of the lower frame member 73 is supported in the upwardly opening channel defined by an outer J-bracket 76 which is attached to the outer rear post 70 in a vertical position corresponding to the center J-bracket 75. With the lower frame member 73 resting in the center and outer J-brackets 75 and 76, the guard rail section 64 is tilted rearwardly (about 5° to the vertical) where the inner end of the upper frame member 74 is received in a forwardly opening center channel bracket 77 and the outer end is received in a forwardly opening outer channel bracket 78. The channel brackets 77 and 78 are attached to respective upper ends of the center and outer rear posts 71 and 70. A pair of aligned holes in the center J-bracket 76 align with a hole in the inner end of the lower frame member 73 for receipt of a connecting pin 79. Similarly, a pair of aligned holes in the outer J-bracket 76 align with a hole near the outer end of the lower frame member 73. A pair of vertically aligned holes in the center channel bracket 77 aligns with a vertical hole in the inner end of the upper frame member 74 for receipt of a connecting pin 79. Similarly, a pair of vertically aligned holes in the outer channel bracket 78 aligns with a vertical hole near the outer end of the upper frame member 74 for receipt of a connecting pin (see FIG. 14). When the bleacher 10 includes more than three main frame members 11, a shorter intermediate rear guard rail is used to extend between intermediate center rear posts 71. This is because the outer rear guard rail section 64 extends laterally beyond the outer rear post 70 and thus is inherently longer. Attachment of the intermediate rear guard rail to the posts 71, however, is accomplished in a similar manner.

Figure 14:
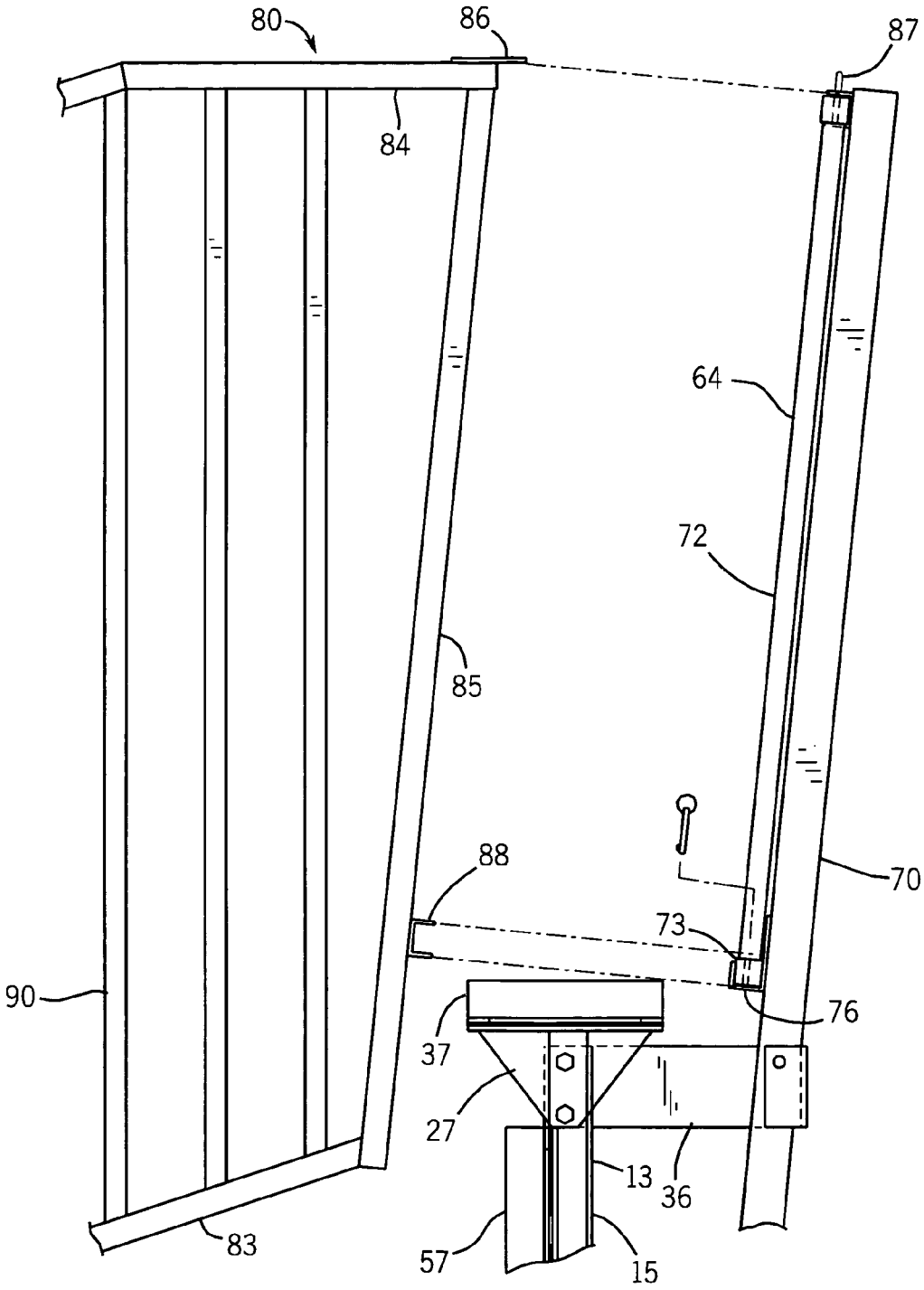
FIG. 14 is a side elevation detail of the connection of the side guard rail section to the rear guard rail section.

Referring now to FIGS. 14 and 15, the assembly of the bleacher 10 is completed by attaching side guard rail sections 80 to opposite ends of the bleacher. As described above, the seat boards 37, foot boards 52 and riser boards 57 are all of equal length and extend outwardly beyond the outer main frame members 11 by, in this embodiment, about 18 inches. In a similar manner, each rear guard rail section 64 also extends laterally outwardly beyond the main frame member and outer rear post 70 by about 18 inches. The side guard rail section 80 is attached at a rear end to the outer end of the rear guard rail section 64 and at a front end to the outer main frame member by a connecting brace 81. The side guard rail section 80 comprises a plurality of vertically oriented parallel rails connected by an upwardly angled upper side frame member 82 and a similarly upwardly angled lower side frame member 83. The rear end 84 of the upper side frame member 82 is angled to be horizontal to facilitate attachment to the rear guard rail section 64. The rear end portion 84 is connected to the rear end of the lower side frame member 83 with an angled rail 85 matching the angle at which the rear guard rail sections 64 are positioned. A short tab 86 is attached to the rear end 84 of the upper side frame member 82 and the tab 86 has a vertical hole that permits it to be hooked onto a vertical pin 87 extending upwardly from the outermost end of the upper frame member 74 with the rear guard rail section 64. Instead of the vertical pin 87, the connection could be made with an arrangement using a demountable pin 79 of a type described with respect to other connections. A rearwardly opening channel bracket 88 is attached to the angled rail 85 of the side guard rail section 80 in a position to receive the outer end of the lower frame member 73 of the rear guard rail section 64. A pair of vertically aligned holes in the channel bracket 88 align with a through hole in the end of the lower frame member 73 through which a pin or other easily demountable connecter is inserted. The forward end of the side guard rail section 80 includes a vertical connector rail 90 by which the guard rail section is attached to the outermost third frame post 91 via the connecting brace 81. The connecting brace includes a generally horizontal member 93 and an acutely angled member 94 which are pinned together at their mid-points. One end of the horizontal member 93 is connected to the threaded stud 22 to which one cross brace member 21 is attached and the corresponding end of the angled member 94 is attached to the lower stud 22 which the other brace member 21 of the cross brace assembly is attached. Thus, those ends of the connecting brace 81 are secured with the same wing nuts 23 as the ends of the indicated cross brace assembly. The outer upper end of the angled member 94 is bolted or pinned to the vertical connector rail 90 at an upper threaded stud and the outer end of the horizontal member 93 is similarly connected to the lower end of the connector rail 90 at a through hole provided therein. To facilitate attachment of the side guard rail sections 80 the rear edge is preferably first attached to the outer end of the rear guard rail section 84 with the previously described vertical pinned connections permitting the side guard rail section 80 to pivot somewhat freely in a horizontal plane. The connecting brace 81 is first attached at its inner ends to the third frame post 91, as previously described, thus permitting the side guard rail section to be pivoted into position for easy connection of the connector rail 90 to the outer ends of the connecting brace 81. Although as indicated previously, the sequence of assembly of the various components of the bleacher may be varied considerably, attachment of the side guard rail sections 80 is completed after all of the seat boards, foot boards and riser boards have been attached, at least to the third through fifth frame posts 13. Otherwise, there will not be enough room to position the various boards on or against their supports and slide them into their latched positions.

As indicated above, the rear guard rail sections 64 can be mounted vertically, as is common in the prior art, or may be tilted rearwardly. Although the rear guard rail sections may be positioned anywhere between vertical and about 20°, a rearward tilt of about 5° is preferred. The unique rearward tilt and angle defining the plane of the rear guard rail sections 64 provides a number of benefits. First of all, it provides a more natural back rest for the comfort of spectators sitting on the uppermost seat board 37. In addition, during assembly, the rear guard rail sections 64 may be placed in position and, before the connecting pins are inserted, the sections will be held in place by gravity and not tend to fall forwardly out of position. Finally, the rear tilt of the entire guard rail assembly 63 provides a sort of natural barrier that tends to keep persons walking behind the bleacher from walking so close that they might trip on one of the lower frame members 12.

The unique latching and locking mechanism for attaching the seat boards 37, foot boards 52 and riser boards 57 to the main frame members saves a very considerable amount of assembly time. In prior art assembleable bleachers, it is not uncommon to use two bolted connections at each point where a seat board is attached to a frame post. Similar bolted connections are used for the foot boards and riser boards. In the two section embodiment described herein, if the seat board were attached in accordance with prior art bolted connections, each seat board would require six bolted connections for each of the five rows. Similar numbers of bolted connections would be required for the foot boards and riser boards for a total of 90 bolted connections. In disassembly, of course, the seat board latching and locking mechanism of the present invention will save a similar amount of time and effort.

What is claimed is:

1. An easily and rapidly assembleable bleacher comprising:

at least two main frame members each having a stepped construction defined by a plurality of horizontally spaced frame posts, the frame posts increasing serially in length from front to rear and having at their upper ends a seat board support, the lower ends of the frame posts attached to a lower frame member, and a horizontal foot board support interconnecting each pair of adjacent frame posts;

a cross brace assembly interconnecting selected pairs of equal height frame posts;

a seat board demountably attachable to the seat board supports of the equal height frame posts with a seat board latching mechanism self-actuated solely in response to horizontal movement of the seat board on the supports to simultaneously latch the seat board to both seat board supports against movement in any direction;

a foot board assembly demountably attachable to the foot board supports between common pairs of adjacent frame posts with a foot board latching mechanism self-actuated solely in response to horizontal movement of the foot board assembly on the foot board supports to simultaneously latch the foot board to both foot board supports against movement in any direction;

a rear guard rail assembly demountably attachable to the rearmost frame posts and including a rear guard rail section extending between the rearmost frame posts; and, a side guard rail demountably attachable at a rear end to each end of the rear guard rail assembly and at a front end to the associated main frame member.

2. The bleacher as set forth in claim 1 including a riser board demountably attachable to selected equal height frame post groups with a riser board latching mechanism self-actuated by horizontal movement of the riser board on the frame posts.

3. The bleacher as set forth in claim 2 wherein each frame post includes a flat flange having a riser board-engaging face and a free edge, and the riser board latching mechanism includes a latch plate defining with the side of the riser board in engagement with the face of the flange a slot adapted to receive the free edge of the flange in response to said horizontal movement of the riser board.

4. The bleacher as set forth in claim 3 including a latch bar pivotally attached at one end to and recessed in the engagement face of the riser board on a vertical pivot axis transverse to the direction of riser board movement, said latch bar having an abutment notch on the other end adapted to be moved into engagement with the frame post after receipt of the edge of the flange in the slot and horizontal pivotal movement of the other end of the latch bar.

5. The bleacher as set forth in claim 4 including a locking mechanism operative to retain the abutment notch in engagement with the frame post.

6. The bleacher as set forth in claim 1 wherein the seat board support comprises a tongue having an upper seat board-supporting face, and the seat board latching mechanism includes a latch plate defining with the underside of the seat board a slot adapted to receive the flat tongue in response to said horizontal movement of the seat board, the slot including a stop engageable by the tongue to establish a latched position.

7. The bleacher as set forth in claim 6 including a latch bar pivotally attached at one end to and recessed in the seat board on a horizontal pivot axis transverse to the direction of seat board movement, said latch bar having an abutment notch on the other end adapted to drop into engagement with the seat board support in response to receipt of the tongue in the slot and downward pivotal movement of said other end of the latch bar.

8. The bleacher as set forth in claim 1 wherein the foot board assembly comprises a pair of foot boards in edge-to-edge engagement, the foot board support comprises a flat support plate having an upper foot board-supporting face and a free edge, and the foot board latching mechanism includes a latch plate for each foot board defining with the underside of the foot board a slot adapted to receive the free edge of the support plate in response to said horizontal movement of the foot board.

9. The bleacher as set forth in claim 8 including a latch bar for each foot board pivotally attached at one end to and recessed in the foot board on a horizontal pivot axis transverse to the direction of foot board movement, said latch bar having an abutment notch on the other end adapted to drop into engagement with the foot board support in response to receipt of the free edge of the support plate in the slot and downward pivotal movement of the other end of the latch bar.

10. The bleacher as set forth in claim 1 wherein all pairs of equal length frame posts are interconnected by cross brace assemblies.

11. The bleacher as set forth in claim 10 wherein the cross brace assembly comprises a pair of elongate brace members pinned together at their centers and connected at opposite ends in the form of an X to respective upper and lower ends of the frame posts.

12. The bleacher as set forth in claim 1 wherein the rear guard rail assembly comprises a pair of substantially vertical rear posts, each supported at a lower end on the rear end of a main frame member and operatively connected at an intermediate location to the upper end of a rearmost frame post, the rear post having a free upper end extending above the intermediate point, and the rear guard rail section comprising a demountable unitary fence-like barrier connected with pinned connectors by a horizontal lower frame member supported at opposite ends to the rear posts adjacent the intermediate locations thereof and with pinned connectors by a horizontal upper frame member supported at opposite ends on the rear posts adjacent the upper ends thereof.

13. The bleacher as set forth in claim 12 wherein the lower end of the rear post is supported with an attachment to the main frame member, and the operative connection of the rear post to the upper end of the rearmost frame post comprises a generally horizontal J-bracket connected by the free end of its longer leg to the frame post and positioned to define with its shorter leg a forwardly opening channel for receipt of the post.

14. The bleacher as set forth in claim 13 wherein the rear posts extend rearwardly at a small angle to the vertical from the lower to the upper ends thereof such that the rear guard rail section lies in a plane extending rearwardly at said angle.

15. The bleacher as set forth in claim 14 wherein the guard rail lower frame member is supported on the intermediate webs of upwardly opening channel brackets and attached by said pinned connectors to the rear posts and the rear guard rail upper frame member is supported in forwardly opening channel brackets and attached by said pinned connectors to the rear posts.

16. The bleacher as set forth in claim 15 wherein the side guard rail comprises a fence-like barrier connected by an upper side frame member and a lower side frame member, a rearmost rail angled to lie parallel with the plane of the rear guard rail section and connected at its upper and lower ends to the rear guard rail section, one of the parallel rails near the front of the side guard rail attached to an adjacent frame post with a connecting brace.

17. The bleacher as set forth in claim 16 wherein the angled rail is connected to the rear guard rail section with connectors permitting rotation of the side guard rail to facilitate connection to the connecting brace.

18. The bleacher as set forth in claim 15 wherein the connections of the rear posts to the J-brackets, the connections of the rear guard rail lower end and upper frame members to the respective upwardly and forwardly opening channel members, and at least one connection of the side guard rail to the rear guard rail sections are secured with easily removable pins.

19. An easily and rapidly assembleable bleacher comprising:

at least two main frame members each having a stepped construction defined by a plurality of horizontally spaced vertical frame posts, the frame posts increasing serially in length from front to rear and having at their upper ends a support for a seat board, the lower ends of the frame posts attached to a lower frame member and a foot board support interconnecting each pair of adjacent frame posts;

a seat board demountably attachable to the supports of the equal length frame posts with a seat board latching mechanism self-actuated by movement of the seat board on the supports; and, a foot board demountably attachable to the foot board supports between common pairs of adjacent frame posts with a foot board latching mechanism self-actuated by movement of the foot board on the foot board supports; and, each of said seat board and foot board latching mechanisms operable solely in response to horizontal movement of the board on the supports to simultaneously secure the respective seat board and foot board against movement in any direction from the latched position.

20. The bleacher as set forth in claim 19 including a riser board demountably attachable to selected equal length frame post groups with a riser board latching mechanism actuated solely in response to movement of the riser board on the frame posts.

21. A bleacher assembly as set forth in claim 19 comprising:

a rear guard rail assembly operatively connected to the rear of the main frame members, the guard rail assembly including a planar rear guard rail section mounted to lie in a plane extending rearwardly and upwardly at a small angle to the vertical.

22. The bleacher assembly as set forth in claim 21 wherein the angle is less than about 20°.

23. The bleacher assembly as set forth in claim 21 wherein the angle is about 5°.

24. An easily and rapidly assembleable bleacher comprising:

at least two main frame members each having a stepped construction defined by a plurality of horizontally spaced vertical frame posts, the frame posts increasing serially in length from front to rear and having at their upper ends a support for a seat board, the lower ends of the frame posts attached to a lower frame member, and foot board supports interconnecting each pair of adjacent frame posts;

brace assemblies interconnecting selected pairs of equal length frame posts;

a seat board demountably attachable to the supports of the equal length frame posts with a seat board latching mechanism actuated by horizontal movement of the seat board along its longitudinal axis on the supports;

said seat board support comprising a flat tongue having an upper seat board-supporting face, and the seat board latching mechanism including a latch plate defining with the underside of the seat board a slot adapted to receive the flat tongue in response to said horizontal movement of the seat board;

a latch bar pivotally attached at one end to and recessed in the seat board on a horizontal pivot axis transverse to the direction of seat board movement, said latch bar having an abutment notch on the other end adapted to drop into engagement with the seat board support in response to receipt of the tongue in the slot and downward pivotal movement of said other end of the latch bar;

a foot board demountably attachable to the foot board supports between common pairs of adjacent frame posts with a foot board latching mechanism actuated by horizontal movement of the foot board along its longitudinal axis on the foot board supports;

said foot board support comprising a flat horizontal support plate having an upper foot board-supporting face and a free edge, and the foot board latching mechanism including a latch plate for the foot board defining with the underside of the foot board a slot adapted to receive the free edge of the support plate in response to said horizontal movement of the foot board; and, a latch bar for the foot board pivotally attached at one end to and recessed in the foot board on a horizontal pivot axis transverse to the direction of foot board movement, said latch bar having an abutment notch on the other end adapted to drop into engagement with the foot board support in response to receipt of the free edge of the support plate in the slot and downward pivotal movement of the other end of the latch bar.

25. The bleacher as set forth in claim 24 including a riser board demountably attachable to selected equal length frame post groups with a riser board latching mechanism actuated by horizontal movement of the riser board along its longitudinal axis on the frame posts;

each frame post including a flat flange having a riser board-engaging face and a free end, and the rise board latching mechanism including a latch plate defining with the side of the riser board in engagement with the face of the flange a slot adapted to receive the free edge of the flange in response to said horizontal movement of the riser board; and, a latch bar pivotally attached at one end to and recessed in the engagement face of the rise board on a vertical pivotal axis transverse to the direction of riser board movement, said latch bar having an abutment notch n the other end adapted to be moved into engagement with the frame post after receipt of the edge of the flange in the slot and horizontal pivotal movement of the other end of the latch bar.

26. The bleacher as set forth in claim 25 including a locking mechanism operative to retain the abutment notch in engagement with the frame post.

27. A method for easily and rapidly assembling a bleacher comprising the steps of:

(1) providing at least two main frame members each having a stepped construction defined by a plurality of horizontally spaced vertical frame posts, the frame posts increasing serially in length from front to rear and having at their upper ends a seat board support, the lower ends of the frame posts attached to a lower frame member, and a horizontal foot board support interconnecting each pair of adjacent frame posts;

(2) interconnecting the main frame members with a cross brace assembly;

(3) attaching a seat board to the seat board supports of the equal length frame posts with a seat board latching mechanism self-actuated solely by longitudinal horizontal movement of the seat board on the supports; and, (4) attaching a foot board to the foot board supports between common pairs of adjacent frame posts with a foot board latching mechanism self-actuated solely by longitudinal horizontal movement of the foot board on the foot board; and, (5) each of said attaching steps operable to simultaneously latch the seat board and the foot board to a respective pair of seat board and foot board supports.

28. The method of claim 27 including the steps of:

(1) attaching a rear guard rail to the rearmost frame posts; and, (2) attaching a side guard rail at a rear end to each end of the rear guard rail and at a front end to an adjacent main frame member.

29. The method as set forth in claim 28 including the step of demountably attaching a riser board to selected equal length frame post groups with a riser board latching mechanism actuated by horizontal movement of the riser board on the frame posts.

30. An easily and rapidly assembleable bleacher comprising:

at least two main frame members each having a stepped construction defined by a plurality of horizontally spaced vertical frame posts, the frame posts increasing serially in length from front to rear and having at their upper ends a support for a seat board, the lower ends of the frame posts attached to a lower frame member, and a foot board support interconnecting each pair of adjacent frame posts;

a seat board demountably attachable to the supports of the equal length frame posts with a seat board latching mechanism self-actuated by movement of the seat board on the supports;

a foot board demountably attachable to the foot board supports between common pairs of adjacent frame posts with a foot board latching mechanism self-actuated by movement of the foot board on the foot board supports;

each of said seat board and foot board latching mechanisms operable solely in response to horizontal movement of the board on the supports to simultaneously secure the respective seat board and foot board against movement in any direction from the latched position; and a rear guard rail assembly including a pair of rear posts, each supported at a lower end on a lower frame member and operatively connected at an intermediate location to the upper end of a rearmost frame post, the rear post having a free upper end extending above the intermediate location, and a unitary planar rear guard rail section having a horizontal lower frame member and a horizontal upper frame member each received in open channel brackets on said rear posts and demountably attached with pinned connectors to the rear posts adjacent the intermediate locations and the upper ends thereof, said rear posts extending rearwardly at a small angle to the vertical from the lower to the upper ends thereof such that the rear guard rail section lies in a plane extending rearwardly at said angle.

31. The bleacher as set forth in claim 30 wherein the channel brackets for the guard rail lower frame member are upwardly opening the channel brackets for and the rear guard rail upper frame member are forwardly opening.

32. An easily rapidly assembleable bleacher comprising:

at least two main frame members each having a stepped construction defined by a plurality of horizontally spaced frame posts, the frame posts increasing serially in length from front to rear and having at their upper ends a seat board support, the lower ends of the frame posts attached to a lower frame member, and a horizontal foot board support interconnecting each pair of adjacent frame posts;

a cross brace assembly interconnecting selected pairs of equal height frame posts;

a seat board demountably attached to the seat board supports of the equal height frame posts with a seta board latching mechanism self-actuated solely in response to horizontal movement of the seat board on the supports to simultaneously latch the seat board to both seat board supports against movement in any direction; and, a foot board assembly demountably attachable to the foot board supports between common pairs of adjacent frame posts with a foot board latching mechanism self-actuated solely in response to horizontal movement of the good board assembly on the foot board supports to simultaneously latch the foot board to both foot board supports against movement in any direction.

33. The bleacher as set forth in claim 32 including a riser board demountably attachable to selected equal height frame post groups with a riser board latching mechanism self-actuated by horizontal movement of the riser board on the frame posts.

* * * * *